US009662591B2

(12) United States Patent
Muller

(10) Patent No.: US 9,662,591 B2
(45) Date of Patent: May 30, 2017

(54) NON-CONTACT METHOD TO DETECT MODEL RAILROAD TURNOUT POINTS POSITION

(71) Applicant: Alexander Muller, Wright City, MO (US)

(72) Inventor: Alexander Muller, Wright City, MO (US)

(73) Assignee: Atlas Model Railroad Company, Hillside, NJ (US)

( * ) Notice: Subject to any disclaimer, the term of this patent is extended or adjusted under 35 U.S.C. 154(b) by 0 days.

(21) Appl. No.: 14/186,322

(22) Filed: Feb. 21, 2014

(65) Prior Publication Data

US 2014/0263863 A1 Sep. 18, 2014

Related U.S. Application Data

(60) Provisional application No. 61/779,159, filed on Mar. 13, 2013.

(51) Int. Cl.
*A63H 19/32* (2006.01)

(52) U.S. Cl.
CPC ..... *A63H 19/32* (2013.01)

(58) Field of Classification Search
CPC ..... B61L 5/107; A63H 19/32
USPC ..... 246/220.415 A
See application file for complete search history.

(56) References Cited

U.S. PATENT DOCUMENTS

| | | | | |
|---|---|---|---|---|
| 5,806,809 | A * | 9/1998 | Danner | 246/220 |
| 6,427,949 | B1 * | 8/2002 | Hager et al. | 246/220 |
| 6,549,005 | B1 * | 4/2003 | Hay et al. | 324/217 |
| 6,588,710 | B1 * | 7/2003 | Taylor | 246/220 |
| 7,577,502 | B1 * | 8/2009 | Henry et al. | 701/19 |
| 8,152,111 | B1 * | 4/2012 | Bryan | 246/220 |
| 2004/0144896 | A1 * | 7/2004 | Shams | 246/220 |
| 2005/0110482 | A1 * | 5/2005 | Ballinger | 324/207.25 |
| 2008/0115372 | A1 * | 5/2008 | Vogel et al. | 33/1 Q |

* cited by examiner

*Primary Examiner* — Sarah McPartlin
(74) *Attorney, Agent, or Firm* — Hauptman Ham, LLP

(57) ABSTRACT

A method and apparatus for detecting the actual and true position of model railroad turnout points while not adding any load or hindrance to the turnout points or to said points operating mechanism. The movable, tapered rails of railroad turnouts are called points, and their position determines the route that the train will follow. Using Hall-effect switches and magnets, the actual and true position of the turnout throw bar and points is detected without any physical contact with the throw bar, the points, or with the mechanism that actuate said throw bar and points. The output of the Hall-effect switches is used to communicate and provide feedback of the actual position of the points to the position display indicators, which are observed by the model railroad operator, and to the model railroad control system.

20 Claims, 10 Drawing Sheets

NON-CONTACT METHOD TO DETECT MODEL RAILROAD TURNOUT POINTS POSITION

CROSS-REFERENCE TO RELATED APPLICATIONS

Not Applicable (See ADS for reference to provisional)

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

This invention relates in general to model railroad switch tracks or turnouts, to the detection of the position of said turnout movable rails, also called switch points or simply points, the corresponding train route, and to the feedback of the position of said movable rails or points to the model railroad operator and to the model railroad control system. [NOTE: To avoid confusion with an electrical 'switch', the term 'turnout' will solely be used henceforth to mean a railroad switch or switch track.], Railroad turnouts, whether on model railroads or real life full-scale railroads, make it possible for trains to follow one out of generally two selectable routes. [NOTE: Henceforth, the term 'train' will be used to denote a locomotive, multiple locomotives, railroad cars, or locomotives and cars.]

A railroad turnout includes: a) Fixed stock rails upon which the train wheels run; b) Crossties, which are commonly made of wood and are laid perpendicular to the stock rails, transfer loads to the track ballast and sub grade, hold the rails upright and keep them spaced to the correct gauge; c) Movable, tapered rails, which are anchored at one end and are free to move at the opposite end, called switch points (or just points), and can generally be moved laterally at the free end into one of generally two positions to select the desired route for the trains to follow; d) Connecting rod or throw bar, which connects the free ends of the points and causes them to move in unison; e) And turnout machine, which is attached to the connecting rod or throw bar with a link, and causes said connecting rod or throw bar to move together with the points.

If for any reason the points fail to move to the desired position when the turnout machine is energized with the expectation that it would cause the points to move to said desired position, or if the points move only part way to said desired position, or if the points drift away from said desired position, the train will not follow the desired route or may derail.

In many model railroads, the actual or true position of the points can usually be verified by the model railroad operator through visual inspection of the turnouts and the position of the points. Whether the turnouts are operated manually by the operator moving a lever with his/her hand, or remotely by the actuation of an electrical device that energizes the turnout machine, the points mostly move as intended, and mostly remain in the desired position.

However, regardless of how the turnouts are operated, it is not uncommon for the turnout points to not move to the intended position or to not remain in that position. If the points do not move into the intended position, the train will not follow the intended route; furthermore, if the points drift away from or move only part way to the intended position, a train derailment will likely occur.

In smaller model railroad dioramas, which consist of scale track and associated controls appropriate for operating model trains, which said dioramas are commonly known as model railroad layouts, it is feasible to frequently conduct a visual inspection of the turnouts to verify the actual position of the points. If the railroad operator sees that the points are not fully in the desired position, the operator can actuate the turnout machine again, whether manually or remotely, and visually check to re-verify the position of the points. If the points remain in the incorrect position or not fully into the desired position, the railroad operator can stop the train and correct or repair the problem turnout.

However, in larger model railroad layouts, due simply to the size of the area expanse of said larger layouts, and the number of turnouts involved, it is not feasible to frequently visually inspect all the turnouts and the position of the points to avoid the potential of a wrong route being followed by the trains, or to avert derailments. For these larger model railroad layouts, easily seen indicator display lights placed in close proximity to the turnouts, and/or a control panel with similar indicator display lights, which said indicator display lights reflect the turnout selected routes based on feedback signals from the turnout route detectors, provide a feasible approach to make possible periodic visual inspections of the turnout selected routes by visual assessment of the turnout position indicator display lights. Some model railroad layouts are also operated by computer based control systems, which control systems accept the aforementioned feedback signals from the turnout route detectors, and can automatically perform any required corrective steps based on the nature of the feedback signals.

Unfortunately, the turnout selected route detection methods available, which provide the feedback signals to the indicator display lights and to the control system do not always reflect the actual route. This occurs because said detection methods do not detect or indicate the actual or true position of the points. As a result, the railroad operator and/or the control system may receive an erroneous feedback of the true position of the points, which would preclude the railroad operator or the control system from taking the appropriate corrective action if such were necessary.

The wrong indication or erroneous feedback of the actual position of the points may occur because the commonly available and used turnout route detection methods generally reflect the position of the turnout machine, but not necessarily of the points. In such cases, while the turnout machine may have moved properly and reached the intended position, the connecting rod or throw bar that mechanically links the turnout machine to the points, and the points, may have not moved as intended. Hence, while the feedback signal may correctly indicate the position of the turnout machine, it might not indicate the actual true position of the connecting rod or throw bar and of the points. [NOTE: While the term 'connecting rod' is more commonly used in full-scale, real railroads, in model railroading the term 'throw bar' is more commonly used, and will be the term used henceforth.]

The above mentioned discrepant indication between the feedback signal and the actual position of the throw bar and points may occur if the throw bar or the points are physically prevented or otherwise blocked from reaching the desired position. Examples of obstacles that can prevent the throw bar and points from reaching the intended position fully include debris, such as a piece of track ballast wedged between the points and the stock rail, and a train stationed over the turnout with one or more of its wheels blocking the movement of the points.

Attempting to use traditional methods of detecting the position of the points in model railroad presents a challenge due to the relatively small size of the turnouts and associated components. These characteristics of model railroad turnouts make it difficult to sense the actual position of the turnout throw bar and points using any sort of mechanical or electromechanical device, such as a limit switch that could be actuated by the throw bar or points, since the sensing device itself would represent an obstacle, and hinder their operation, which could prevent said points from operating properly and reliably. This leaves the generally practical options currently available with existing approaches to generate feedback signals of the selected turnout route, which consist generally of electrical switches of sorts, which are actuated by the turnout machine itself but not by the throw bar or points, or electrical devices that are actuated by the same signals that actuate the turnout machine. Consequently, while these feedback signals may accurately reflect the position of the turnout machine itself, they do not necessarily reflect the actual and true position of the throw bar and points.

The position of the throw bar, and hence the points, may differ from the position of the turnout machine because the linkage between the model railroad turnout machine and the throw bar is intentionally and by design made to be flexible. Although this flexibility hinders a consistent and true correlation of the position of the turnout machine to the throw bar and points, the flexible linkage prevents damage to the turnout machine and its components if the throw bar and points were to be physically blocked from moving to the intended position. In the end, it is more advantageous for the turnout manufacturer as well as to the model railroad enthusiast to forego an accurate correlation of the turnout machine to the throw bar and points, rather than to risk damage to said components.

SUMMARY OF THE INVENTION

A method and apparatus for detecting and indicating the actual and true position of model railroad turnout points such that in the process of detecting said position of the turnout points no additional load is placed on the points, throw bar, or turnout machine, is critical for model railroads to operate reliably. The non-contact proximity method and apparatus described herein does not add any load to the turnout machine, throw bar and points, is rather straight forward to install, and its cost is relatively low. The preferred method and apparatus disclosed herein uses Hall-effect switches and magnets to detect the actual and true position of the turnout throw bar and points, and provides feedback reflecting said actual and true position of the throw bar and points to the model railroad operator and to the model railroad control system. Whereas other non-contact proximity sensors, such as reed switches, photoelectric sensors, inductive-capacitive sensors, and ultrasonic sensors could theoretically also be used, the Hall-effect switch method selected and described herein is believed to be the easiest, most durable, most straightforward, and most cost effective non-contact proximity method for this application.

The small magnet that actuates the Hall-effect switches can easily be mounted on the throw bar in a multiplicity of locations to accommodate the specific needs as dictated by the form of installation of the turnout on the model railroad layout, and the Hall-effect switches can easily be mounted in close proximity to the magnet or magnets, making for an overall easy add-on installation by the model railroad operator. Furthermore, the manufacturer of the turnout could easily incorporate the magnets and Hall-effect switches in the original design and manufacture of the turnouts, and offer said turnouts with the herein disclosed points position detection feature built in.

Regardless of the location of the Hall-effect switches and magnet, when the turnout machine operates and causes the throw bar and the points to move laterally in one or another direction into the desired position, the magnet mounted on the throw bar will move in close proximity to one of two Hall-effect switches, causing said Hall-effect switch to turn on and generate the electrical feedback signal that indicates the actual position of the throw bar and points, and which said signal can be used to illuminate a position indicator and sent to the model railroad control system.

Should the throw bar and points fail to move to the desired position, the incorrect or unintended feedback signal would be generated as the magnet would turn on the incorrect Hall-effect switch, which would not correspond to the intended route, and thus provide the railroad operator or the control system the means to identify the discrepant condition and follow up with the appropriate corrective action. Furthermore, should the throw bar and points move only partially to, or drift away from the desired position, the apparatus and method herein disclosed will provide no feedback signal due to the magnet not having reached the operating threshold of either Hall-effect switch. Such absence of a feedback signal will alert the railroad operator or the control system that the points are not only not in the desired position, but are instead in an in-between position, which would potentially and frequently result in the derailment of the train.

A model railroad that incorporates the herein disclosed non-contact method to monitor the actual and true position of the turnout points, could be operated by means of a manual control system such as from a centrally located control panel that includes light emitting diodes, referred to as LED's henceforth, or similar light displays, to indicate the position of the turnout points, and hence of route the train is expected to follow. In a such a system, not only would the actual and true positions of the turnout points and hence the selected routes be indicated by said lighted displays based on the feedback signals from the herein disclosed method, but would also indicate if the points were not fully positioned in either of the generally two available routes by neither of the two lighted position indicators for a turnout not being illuminated.

When a model railroad is operated with an automated control system such as a computer-based control system, said control system would interpret the feedback signals from the herein disclosed method to determine the actual and true position of the turnout points, and hence the route selected. If the throw bar and points were not fully in either position, as described earlier, the lack of a feedback signal would alert the control system of a discrepant condition.

A model railroad with feedback of the position of the turnout points and selected route would typically be operated by the railroad operator and/or by the control system as follows. (a) The operator or computer control system issues a command signal for a turnout machine to move the throw bar and points into the position that guides the train to the desired route, wherein (b) The turnout machine actuates and moves the throw bar, which is mechanically connected to the turnout machine with a flexible link, and the points, into the desired position, (c) The points position feedback signal generated by the herein disclosed method would enable the operator to visually verify said points position as reflected on indicating displays, or the computer control system to verify the points position based on said feedback signal, (d) And if correct, the operator or the computer control system would allow the train to follow the selected route, (e) Or if the position of the points according to the indicating display or the feedback signal were not as expected, the operator or computer control system would re-issue the command signal for the turnout machine and would re-verify the position of the points. (f) Additionally, if after subsequent turnout machine actuations the position of the points were to remain incorrect, the operator or computer control system would stop the train and prevent it from following the incorrect route or to avert a derailment.

An inaccurate detection of the actual and true position of the points would result in an erroneous feedback signal sent to the operator and computer control system. Such an incorrect feedback signal would fail to alert the operator or the computer control system of the discrepant position of the throw bar and points, and would preclude proper corrective action steps from been taken by the operator or the computer control system. The consequences of the aforementioned circumstances involving an inaccurate detection of the actual and true position of the throw bar and points would entail the train not following the desired route and likely sustain or cause damage by colliding with another train. Likewise, if the points were not in a fully thrown position and this equally discrepant condition were not detected and thus not provided to the operator or to the computer control system so corrective steps could be taken, the train would most likely derail and sustain damage.

The method and apparatus disclosed herein ensures that a feedback signal that correctly reflects the actual and true position of the throw bar and points, be provided to the operator and computer control system so any necessary corrective steps could be taken, and hence the potential damage that would have otherwise resulted from the wrong train route, or a derailment, be avoided.

DETAILED DESCRIPTION OF THE INVENTION

Unipolar Hall-Effect integrated circuit devices, most commonly referred to as Hall-effect switches, and sometimes called Hall-effect sensors, respond to the presence of a magnetic field. In the presence of a magnetic field of the correct polarity and sufficient field strength, the output of the unipolar Hall-effect switch will be in the 'on' state, and in the absence of said magnetic field the output of the unipolar Hall-effect switch will be in the 'off' state. There are other types of Hall-effect switches or sensors, such as bipolar, and omnipolar Hall-effect switches, which generally respond to the presence of a magnetic field in a similar manner, and which could be applied to the herein disclosed method of detection, albeit with some modifications to the circuitry herein disclosed for unipolar Hall-effect switches, that would be appropriate to support said other Hall-effect switches. However, the unipolar Hall-effect switches selected for this application, such as Diodes Incorporated AH337, provide the output drive characteristic best suited for this application, are the simplest and most cost effective to use, and are the only type discussed and considered henceforth.

A multiplicity of implementation configurations of the apparatus herein disclosed; i.e., the mounting locations of the Hall-effect switches and of the magnets, such as neodymium N42 ⅛-inch square and 1/16-inch thick, can be used to implement the concept herein disclosed using said Hall-effect switches, and magnets. These configurations facilitate the herein disclosed apparatus to be added to an existing model railroad layout, where the turnouts already have been installed on the model railroad layout; to new installations, where the turnouts have not yet been installed; and also by the turnout manufacturer, to include the herein disclosed apparatus built in the turnout as offered for sale. As would be expected, some of the available configurations would be better suited to specific turnout installations on the model railroad layout, and to specific brands and types of railroad turnouts.

The basic configuration of the apparatus herein disclosed consisting of Hall-effect switches and magnets for model railroad applications is shown in FIG. 1 through FIG. 8, which depict typical installations of said apparatus.

Figure 1:
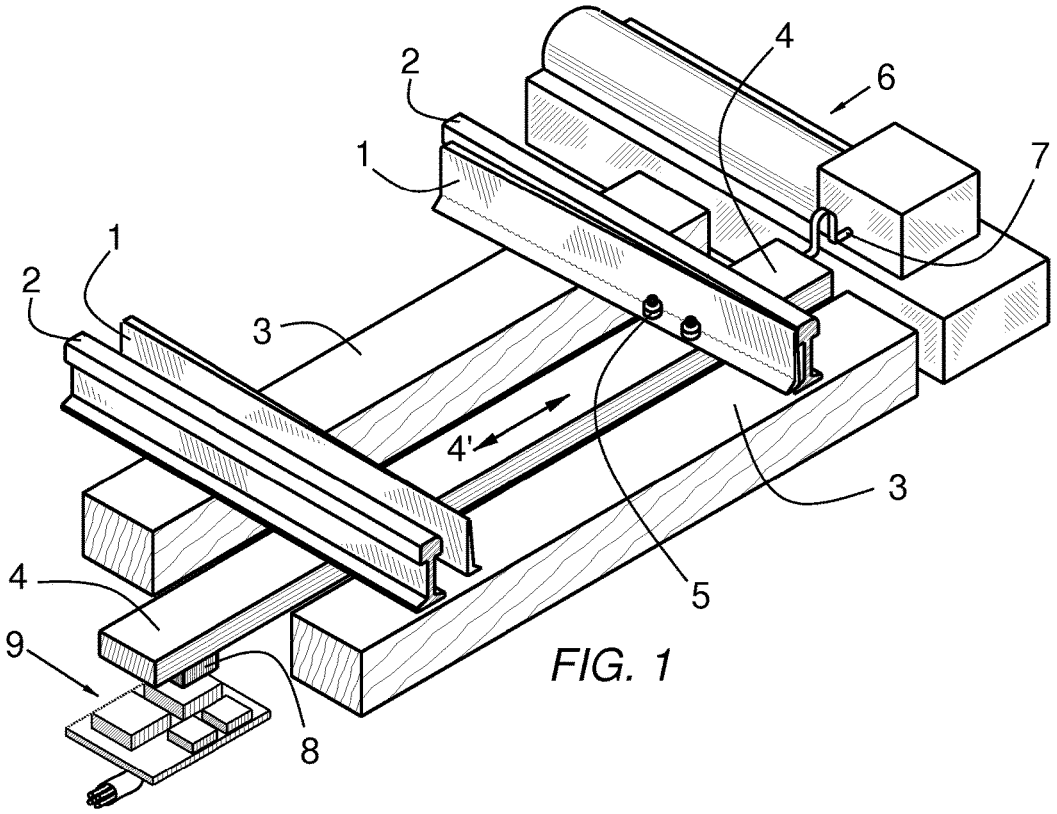
FIG. 1 shows a portion a model railroad turnout, which includes the operational elements of the turnout and a points position Bottom-mount Detector Module.
Figure 20:
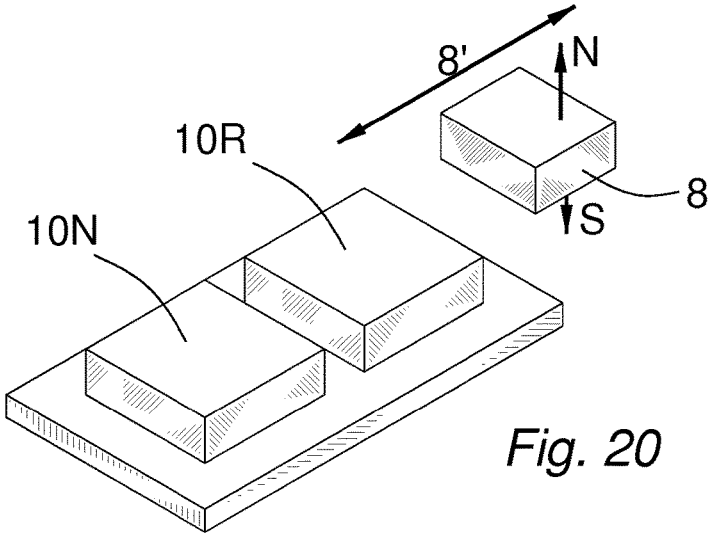
FIG. 20 is an illustration representing the required magnetic orientation of the magnet for proper interaction with the two Hall-Effect switches.

In FIG. 1, the apparatus comprising the proximity detector module 9, described in FIGS. 2, 21, 22 and 23; and the magnet 8, described in FIG. 20, are shown in a bottom-mount installation, wherein detector module 9 is mounted generally on the model railroad layout surface under throw bar 4 and under magnet 8. FIG. 1 shows points 1 that determine the route the train will follow, stock rails 2 upon which the train wheels roll, crossties 3 that hold and support the stock rails and the points, and throw bar 4, onto which the movable ends of points 1 are attached by means of pins or bolts 5. Turnout machine 6 is mechanically connected to throw bar 4 with flexible link 7. When turnout machine 6 is actuated, it moves link 7, which in turn moves throw bar 4 and points 1 laterally as depicted by 4'. Consequently, magnet 8, attached at end and bottom side of throw bar 4 such as with cyanoacrylate adhesive, also moves laterally, as depicted by 4'. The travel limits of lateral motion 4' of throw bar 4, points 1, and magnet 8 correspond to two possible and opposite positions of points 1, each of which said positions determines a route for the train, as illustrated by 18'N (FIG. 11) for Normal or straight-through route travel of the train, and 18'R (FIG. 14), for Reverse or diverging route travel of the train.

When turnout machine 6 actuates throw bar 4 by means of link 7 to move laterally 4' and reach the Normal or Reverse position of points 1, magnet 8 will also move such that it will be within the operation threshold of either Hall-effect switch 10N or 10R (FIG. 2), causing the corresponding Hall-effect switch 10N or 10R to generate the feedback signal.

Figure 2:
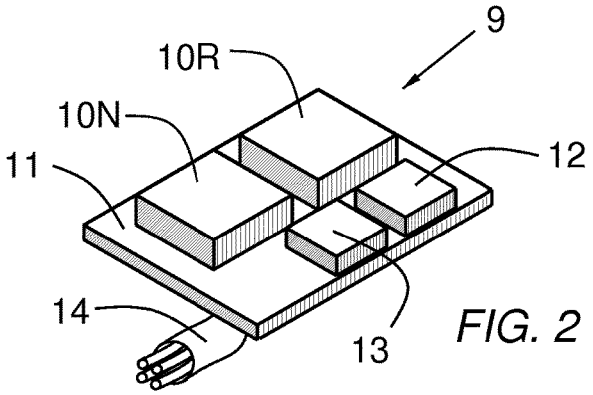
FIG. 2 is a diagram of a points position Bottom-mount Detector Module.
Figure 13:
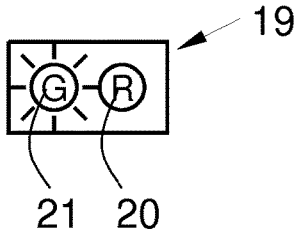
FIG. 13 depicts a display with indicators for Normal and Reverse routes, with the Normal route green indicator illuminated to match the position of the points. Note: a green indicator is traditionally associated with a normal route.
Figure 16:
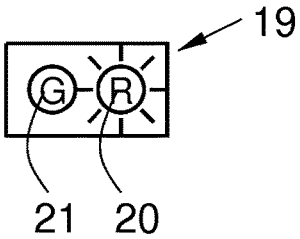
FIG. 16 depicts a display with indicators for Normal and Reverse routes, with the Reverse route red indicator illuminated to match the position of the points. Note: a red indicator is traditionally associated with a reverse route.
Figure 19:
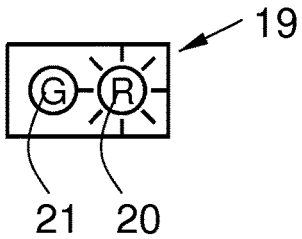
FIG. 19 depicts a display with indicators for Normal and Reverse routes, with the Reverse route indicator illuminated to match the position of the points.

FIG. 2 shows detector module 9 used for the bottom-mount installation described above, and consisting of printed circuit board 11 with two Hall-effect switches 10N and 10R, diode 12 for electric polarity protection, current limiting resistor 13, and four-wire cable 14 that connects the detector module to the control system and to other devices such as two-color indicator display 19 (FIGS. 13, 16, and 19).

Figure 3:
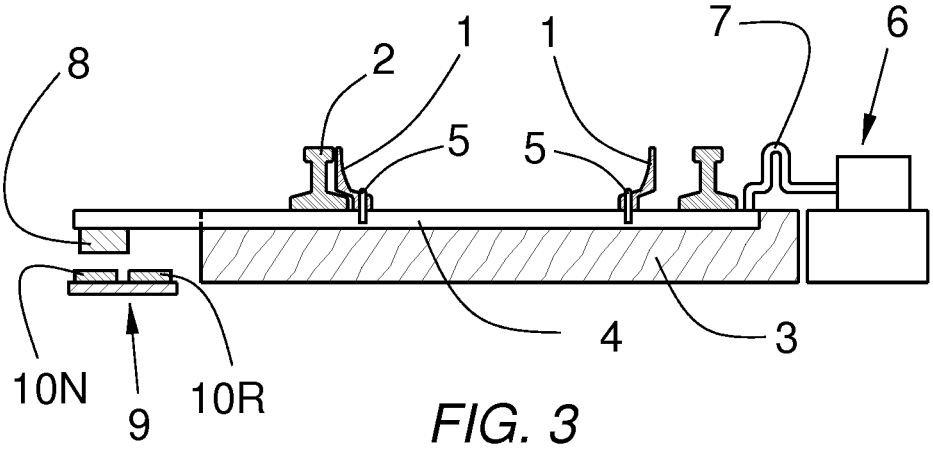
FIG. 3 is a cross-sectional view of FIG. 1 depicting the turnout points in position for Normal or straight-through route.
Figure 4:
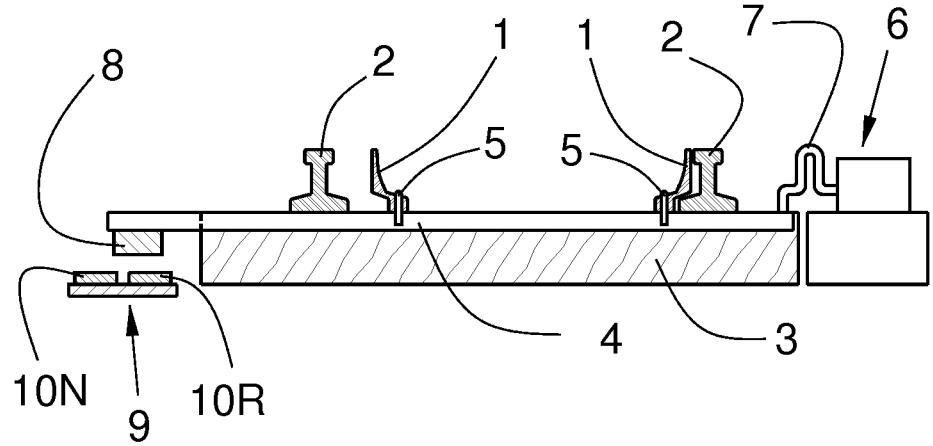
FIG. 4 is a cross-sectional view of FIG. 1 depicting the turnout points in position for Reverse or diverging route.
Figure 11:
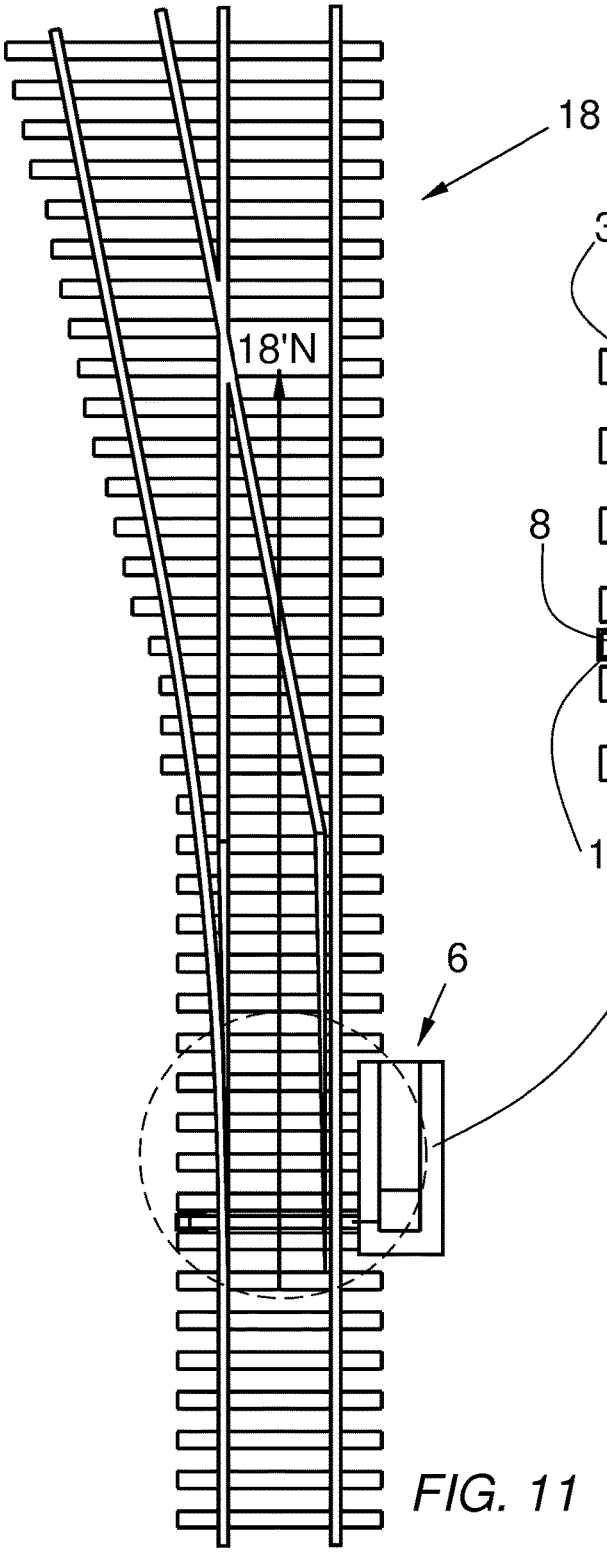
FIG. 11 is a plan view of a Left-Hand turnout with the points set Normal for straight-through route.
Figure 14:
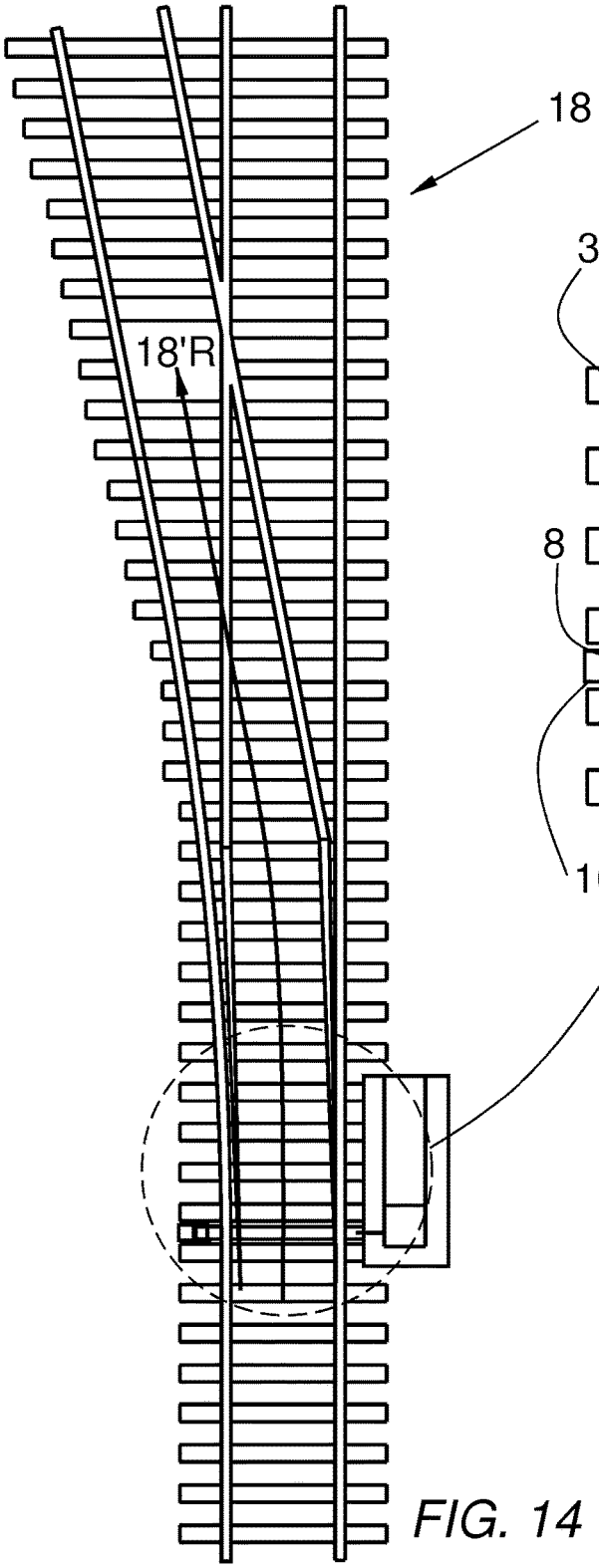
FIG. 14 is a plan view of a Left-Hand turnout with the points set Reverse or diverging route.

FIG. 3 shows bottom-mount detector module 9 configuration where turnout machine 6 has been actuated by the railroad operator or by the computer control system, to select Normal, straight through route 18'N (FIG. 11). Link 7 has moved throw bar 4 and points 1 into Normal position, and magnet 8 has moved into the operating threshold of Hall-effect switch 10N, which generates the feedback signal indicating that points 1 are in Normal position. FIG. 4 shows bottom-mount detector module 9 configuration where turnout machine 6 has been actuated by the railroad operator or by the computer control system, to select Reverse, diverging route 18'R (FIG. 14). Link 7 has moved throw bar 4 and points 1 into Reverse position, and magnet 8 has moved into the operating threshold of Hall-effect switch 10R, which generates the feedback signal indicating that points 1 are in Reverse position.

Figure 5:
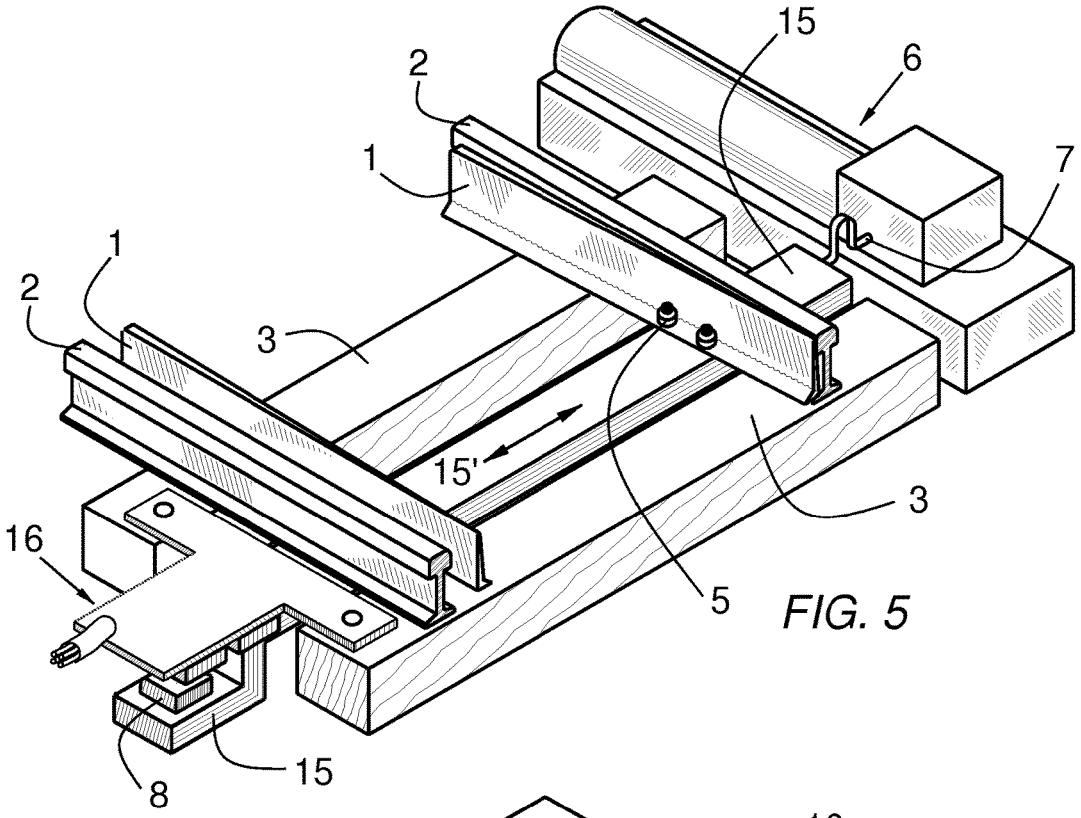
FIG. 5 shows a portion of a model railroad turnout, which includes the operational elements of the turnout and a points position Top-mount Detector Module.
Figure 6:
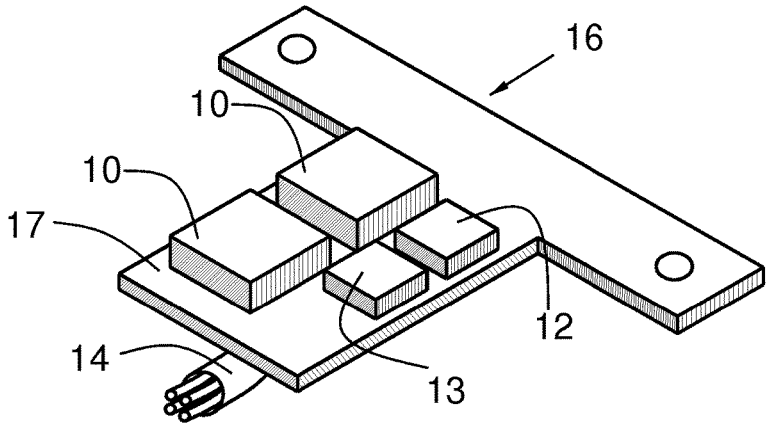
FIG. 6 is a diagram of a points position Top-mount Detector Module.

FIG. 5 and FIG. 6 are similar to FIG. 1 and FIG. 2 respectively, but show the apparatus comprising proximity detector module 16 and magnet 8 in location for a top-mount installation, wherein detector module 16 is mounted generally over and attached to the top of crossties 3 over throw bar 15 and magnet 8. FIG. 5 shows throw bar 15, similar to throw bar 4 (FIG. 1) except for the end where magnet 8 is mounted, which is designed to allow space necessary for magnet 8 to be mounted under detector module 16, and moves laterally as depicted by 15'. FIG. 6 shows detector module 16 used for the top-mount installation described above, consisting of printed circuit board 17 with two Hall-effect switches 10N and 10R, diode 12 for electric polarity protection, current limiting resistor 13, and four-wire cable 14 that connects detector module 16 to the control system and to other devices such as two-color indicator display 19 (FIGS. 13, 16, and 19).

Figure 7:
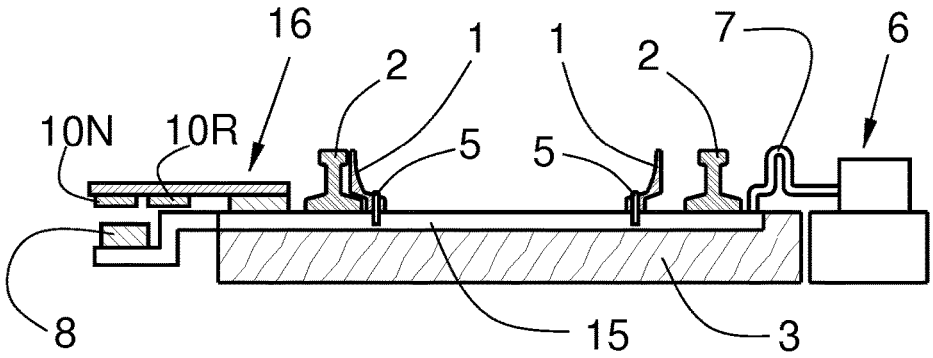
FIG. 7 is a cross-sectional view of FIG. 5 depicting the turnout points in position for Normal or straight-through route.
Figure 8:
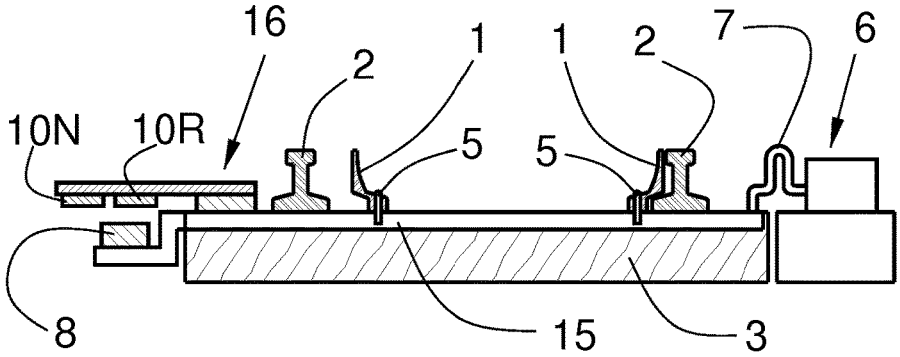
FIG. 8 is a cross-sectional view of FIG. 5 depicting the turnout points in position for Reverse or diverging route.

FIG. 7 and FIG. 8 are similar to FIG. 3 and FIG. 4 respectively, but show detector module 16 in a top-mount configuration. FIG. 7 shows top-mount detector module 16 configuration where turnout machine 6 has been actuated, by the railroad operator or by the computer control system, to select the Normal, straight through route 18'N (FIG. 11). Link 7 has moved throw bar 15 and points 1 into Normal position, and magnet 8 has moved into the operating threshold of Hall-effect switch 10N, which generates the feedback signal indicating that points 1 are in Normal position. FIG. 8 shows top-mount detector module 16 configuration where turnout machine 6 has been actuated, by the railroad operator of by the computer control system, to select Reverse, diverging route 18'R (FIG. 14). Link 7 has moved throw bar 15 and points 1 into Reverse position, and magnet 8 has moved into the operating threshold of Hall-effect switch 10R, which generates the feedback signal indicating that points 1 are in Reverse position.

Figure 9:
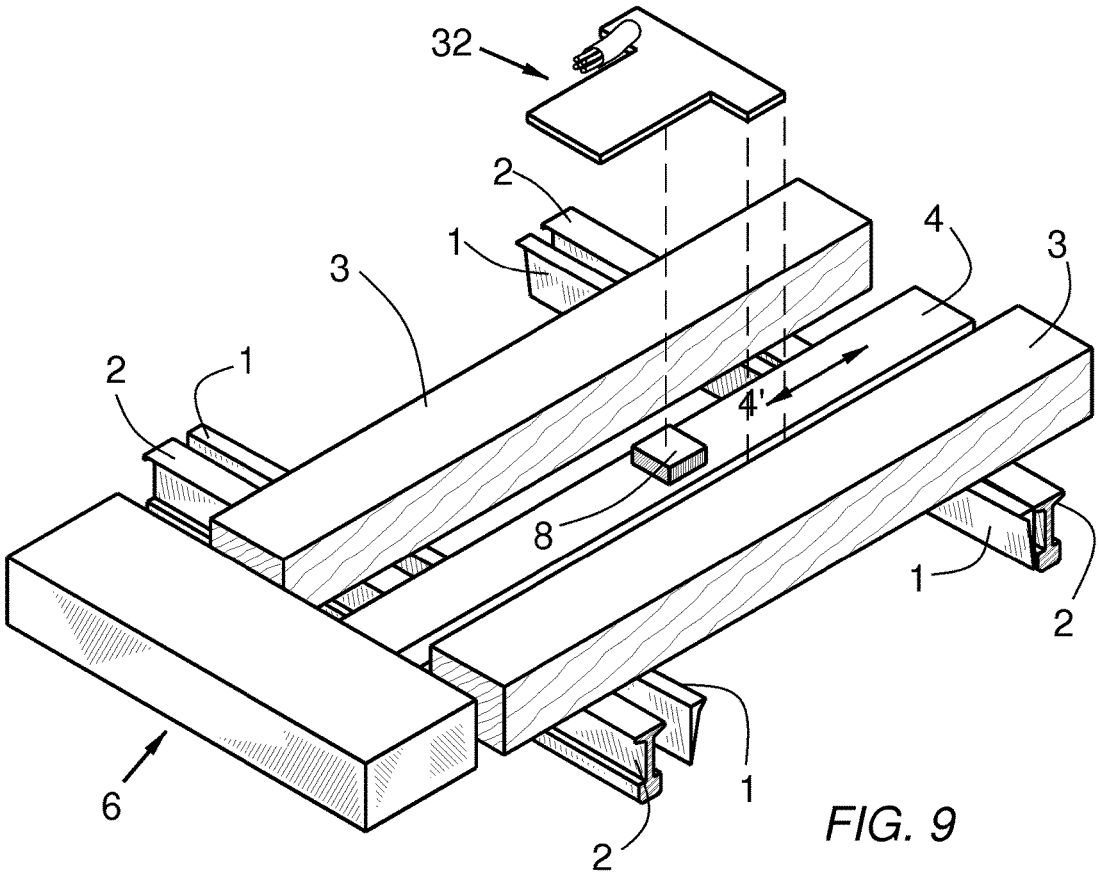
FIG. 9 shows a bottom view of a portion of a turnout, which includes the operational elements of the turnout and a points position Mid-Bottom-mount Detector Module as would be installed on the bottom of the turnout. While the previous bottom and top mount detector module installations are best suited for a turnout that already has been installed on a model railroad layout, the Mid-Bottom-mount Detector Module installation is the best choice for new, uninstalled turnouts as it can easily be installed by the model railroad operator, as well as by the turnout manufacturer who could then offer the turnout as a complete product with the herein disclosed point position detection method included.

FIG. 9 is similar to FIG. 1, but shows a bottom view of the turnout with the apparatus comprising proximity detector module 32 and magnet 8 located in a mid-bottom-mount installation, wherein detector module 32 is mounted under and generally close to but not necessarily the center of throw bar 4, and magnet 8 is attached under throw bar 4 close to but not necessarily at its center. Detector module 32 could be mounted on the surface of the model railroad layout upon which the turnout would be installed, or could be attached to the bottom side of the turnout itself between crossties 3. FIG.

10 shows detector module 32 used for the mid-bottom-mount installation described above, consisting of printed circuit board 33 with two Hall-effect switches 10N and 10R, diode 12 for electric polarity protection, current limiting resistor 13, and four-wire cable 14 that connects detector module 16 to the control system and to other devices such as two-color indicator display 19 (FIGS. 13, 16, and 19).

Figure 12:
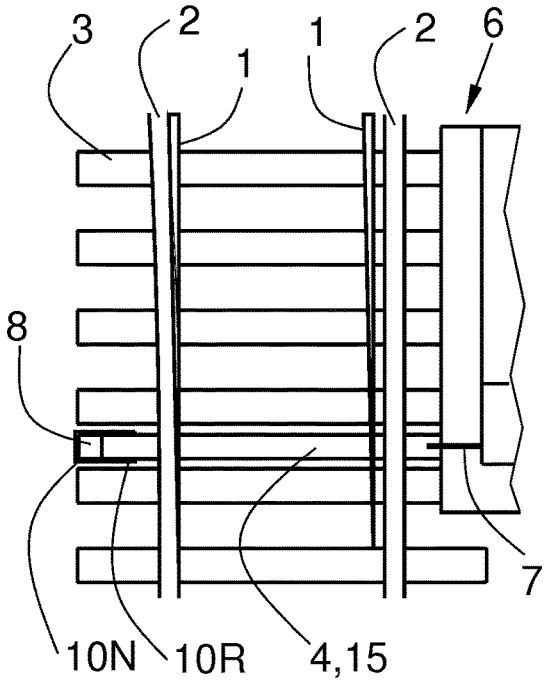
FIG. 12 is an expanded partial view of FIG. 11 showing the operational elements of the turnout.

FIG. 11 and FIG. 12 show turnout 18 with points 1 set for Normal, straight through route 18'N. FIG. 11 is a plan view of complete left-hand turnout 18 and FIG. 12 an expanded view of a portion of said turnout 18 with throw bar 4 or 15, points 1 and magnet 8 over Hall-effect switch 10N, all in Normal position. FIG. 13 shows two-color indicator display 19 with Normal indicator 21 illuminated by the feedback signal from Hall-effect switch 10N. Said two-color display 19 includes green light 21, such as green LED 26 (FIG. 21), to indicate Normal or straight through route, and red light 20, such as red LED 25 (FIG. 21), to indicate Reverse or diverging route.

Figure 15:
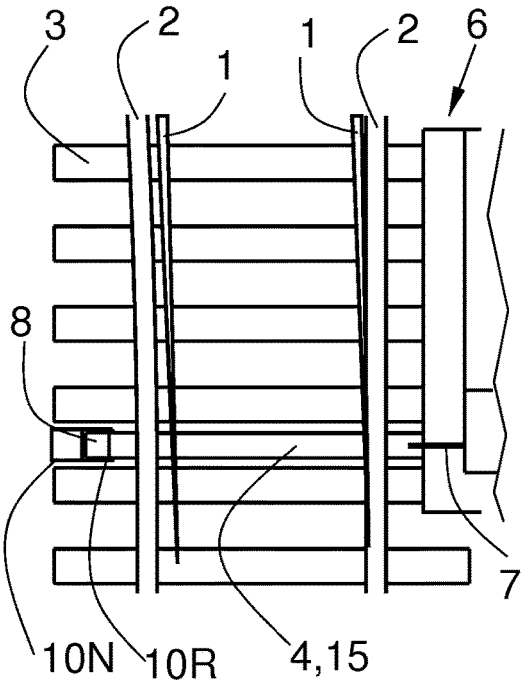
FIG. 15 is an expanded partial view of FIG. 14 showing the operational elements of the turnout.

FIG. 14 and FIG. 15 show a turnout with points 1 set for Reverse diverging route 18'R. FIG. 14 is a plan view of complete left-hand turnout 18 and FIG. 15 an expanded view of a portion of said turnout 18 with throw bar 4 or 15, points 1 and magnet 8 over Hall-effect switch 10R, all in Reverse position. FIG. 16 is two-color indicator display 19 with Reverse indicator 20 illuminated by the feedback signal from Hall-effect switch 10R.

Figure 17:
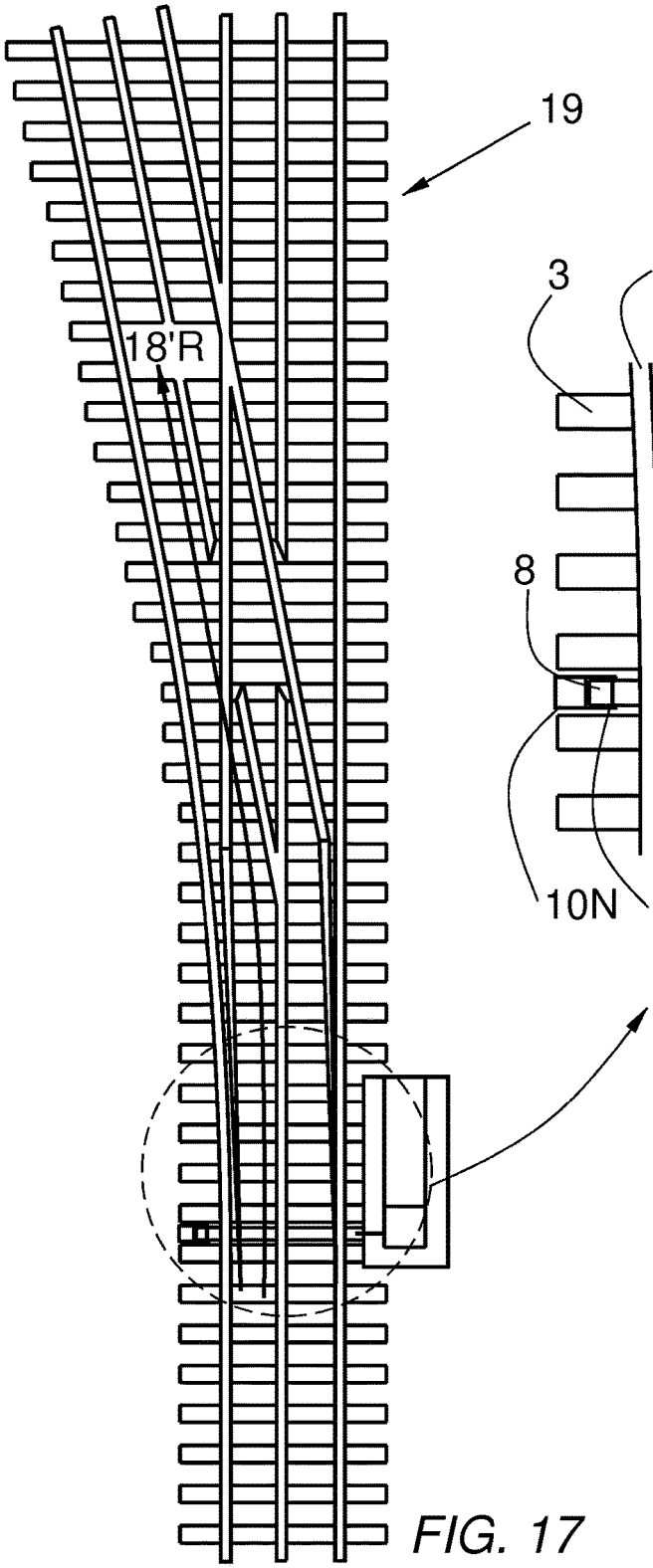
FIG. 17 is a plan view of a Left-Hand 3-Rail turnout, which said 3-rail turnouts are used commonly in 1:48 scale model railroads, with the points set Reverse or diverging route. The operation of 3-rail turnouts is identical to the operation of the previously shown 2-Rail turnouts, and the purpose of this 3-rail figure is to show that the herein disclosed method can be equally applied to said 3-rail turnouts.
Figure 18:
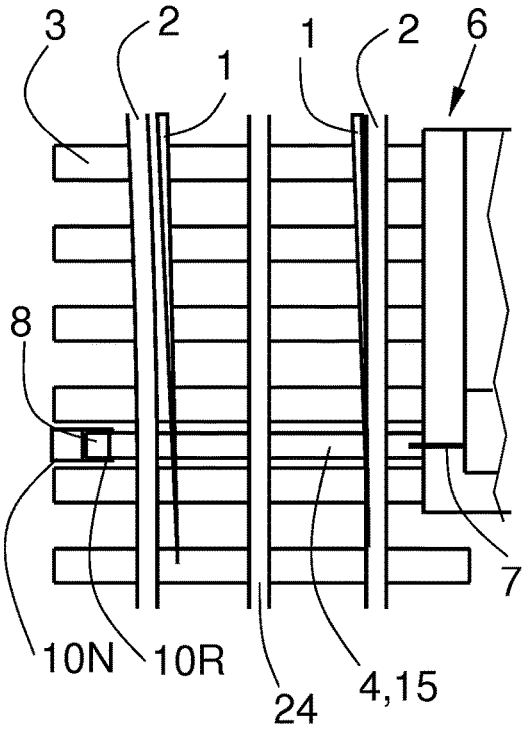
FIG. 18 is an expanded partial view of FIG. 17 showing the operational elements of the turnout.

FIG. 17 and FIG. 18 are similar to FIG. 14 and FIG. 13 respectively, but instead show 3-rail turnout 19, as commonly used in 1:48 scale O-Gauge model railroads. The third rail 24 is a stock rail centrally located between the outer two stock rails 2, and its purpose is to provide the electric current required for 3-rail trains. The operation of 3-rail turnout 19 and its components is the same as for 2-rail turnouts 18. FIG. 17 is a plan view of complete 3-rail left-hand turnout 19 and FIG. 18 an expanded view of a portion of said turnout 19 with throw bar 4 or 15, points 1 and magnet 8 over Hall-effect switch 10R, all in Reverse position. FIG. 19 is two-color indicator display 19 with Reverse indicator 20 illuminated by the feedback signal from Hall-effect switch 10R.

Note: Turnouts 18 and 19 shown and described previously are left-hand turnouts where the Reverse, diverging route is oriented to the left. The complementary right-hand turnouts, which also are widely available and used, function and are operated as the left-hand turnouts, but have a Reverse, diverging route oriented to the right.

FIG. 20 illustrates the magnetic polarity orientation of magnet 8 as required to cause a change in ON and OFF states of unipolar Hall-effect switches 10N and 10R. An example of a suitable magnet for this application is a commercially available neodymium N42 ⅛-inch square and 1/16-inch thick magnet. When magnet 8 moves in direction 8', it comes in close proximity to either Hall-effect switch 10N or 10R, causing the Hall-effect switch in close proximity to turn on and generate the appropriate feedback signal, while the other Hall-effect switch remains off and does not generate a feedback signal. Please note that the magnetic polarity orientation for other types of Hall-effect switches may be different than as shown in FIG. 20.

Figure 10:
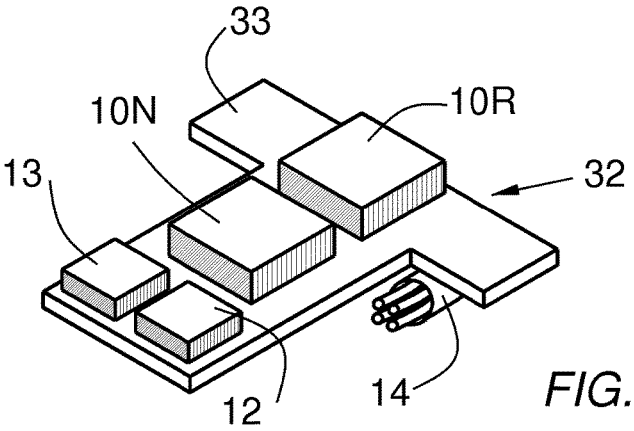
FIG. 10 is a diagram of a points position Mid-Bottom-mount Detector Module.
Figure 21:
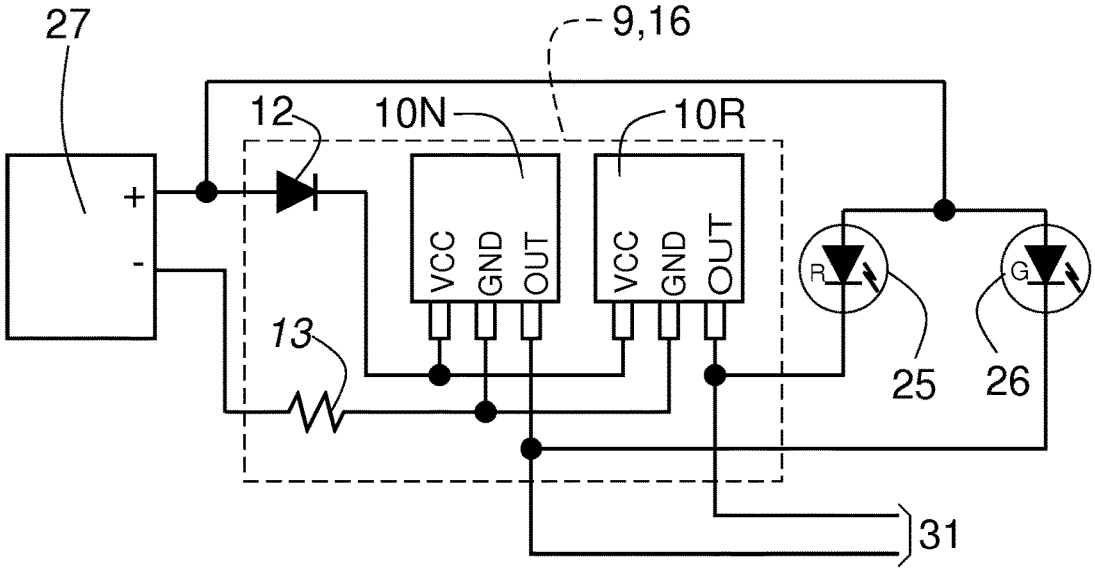
FIG. 21 is the schematic diagram of the circuit required for the operation of the method herein disclosed using two discrete, different color LED's as position indicators.

FIG. 21 shows the schematic circuit diagram with the components necessary for implementation of the apparatus herein disclosed. Hall-effect switches 10N and 10R turn on when a magnetic field of the proper polarity and strength is within their operating threshold distance, and provide the signal corresponding to the position of the points 1 such as to illuminate LED 25 or LED 26, and/or provide the feedback signal 31 to the control system. Circuit components Hall-effect switches 10N and 10R, together with diode 12 and resistor 13 comprise the previously described detector module 9 (FIG. 2), detector module 16 (FIG. 6), and detector module 32 (FIG. 10).

In FIG. 21, Power supply 27, with an output of 12 volts direct current, supplies the electric power required to operate the herein apparatus disclosed. Said power supply 27 would generally be placed remotely from the turnouts in a convenient location such as the control center of the model railroad. Hall-effect sensors 10N and 10R, such as Diodes Incorporated Hall-effect switch part number AH337, have proven to be ideal for this application due to their sensitivity and output drive characteristic. LED 25, is a standard red LED, such as Lite-On Red LED part number LTL-307R, and LED 26, a standard green LED, such as Lite-On Green LED part number LTL-307G. Diode 12, such as commonly available 1N4004, prevents damage to the components if power supply 27 were to be connected to the circuit incorrectly. Resistor 13, with a typical value of 560 ohms, limits the current through the circuit to protect Hall-effect switches 10N and 10R.

LED's 25 and 26 comprise two-color indicator display 19 (FIGS. 13, 17, and 19), wherein LED 25 illuminates Red when turned on by the signal generated by Hall-effect switch 10R to indicate Reverse, or diverging route; and LED 26 illuminates Green when turned on by the signal generated by Hall-effect switch 10N to indicate Normal, straight through route. Two-color indicator display 19 can be installed in a multiplicity of locations as would be suited to the specific model railroad layout, such as on the model railroad layout in close proximity to the turnout, or on the control system control panel, and could also be installed on both locations. In addition to using the signals generated by Hall-effect switches 10N and 10R to illuminate LED 25 and LED 26, said signals can be used as feedback signals 31 that would be used by the model railroad control system.

Figure 22:
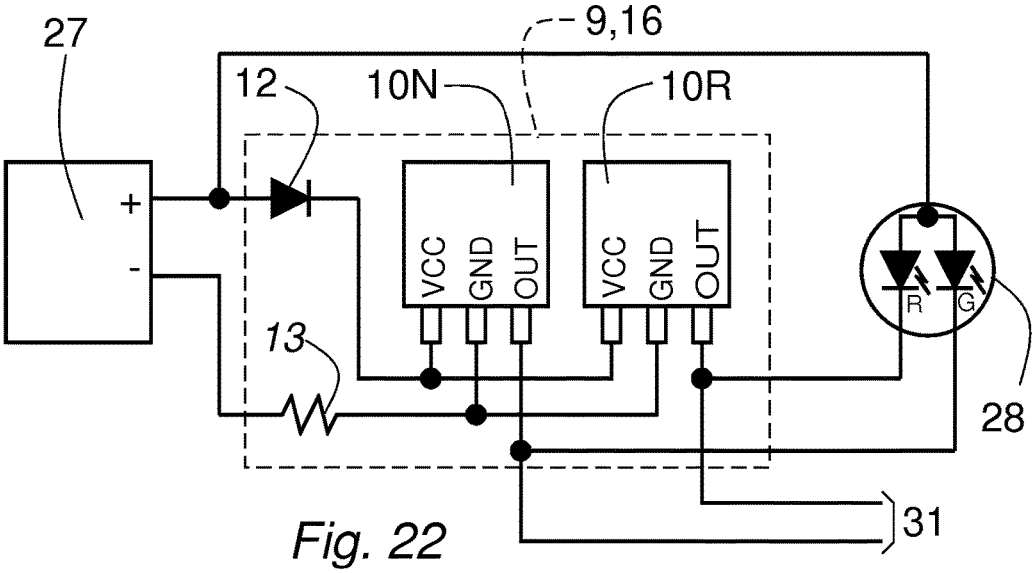
FIG. 22 is the schematic diagram of the circuit required for the operation of the method herein disclosed using a single, bicolor common-anode LED as position indicator.
Figure 23:
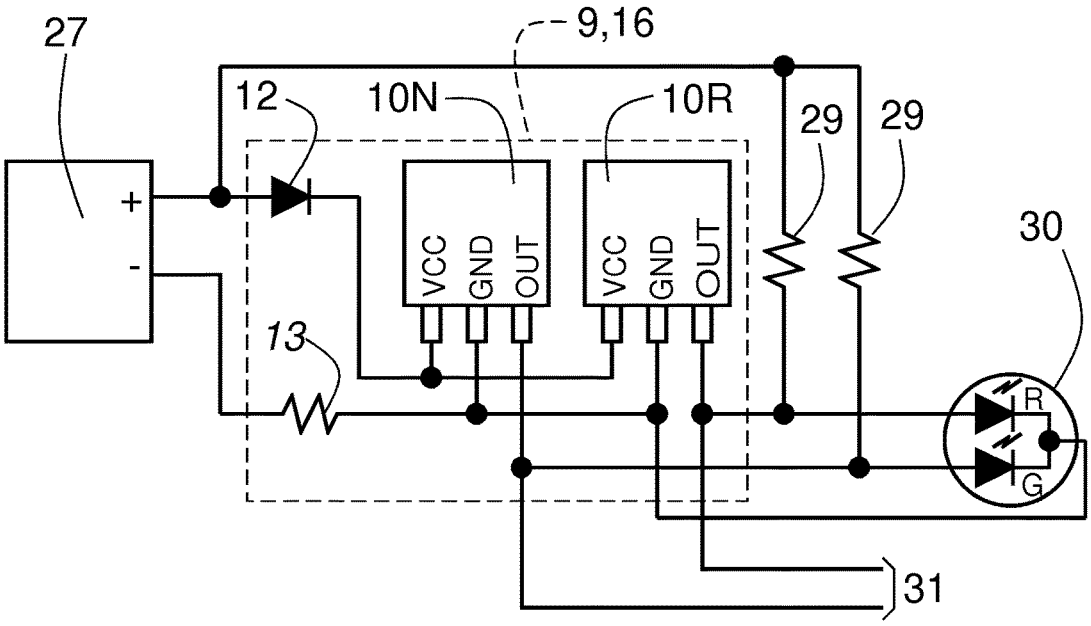
FIG. 23 is the schematic diagram of the circuit required for the operation of the method herein disclosed using a single, bicolor common-cathode LED as position indicator.

FIG. 22 is a circuit similar to the one in FIG. 21, but replaces both LED 25 and LED 26 with single, common-anode, bi-color (green & red) LED 28, such as Bivar part number 5BC-3-CA-F. The operation of single, bi-color LED 28, which illuminates green or red according to the signals generated by Hall-effect switches 10N and 10R, provides the same operation as combined pair of LED 25 with LED 26, with the advantage that single LED 28 requires less space for installation than two separate LED's. FIG. 23 is a circuit similar to the one in FIG. 22, but instead of common-anode, bi-color LED 28, it uses common-cathode, bi-color LED 30, such as Ligitek LHG3392. Use of common-cathode LED 30 requires the addition of two biasing resistors 29, with a typical value of 10K ohms.

What is claimed is:

1. A method of detecting model railroad turnout points position comprising:

placing at least one magnet component of a non-contact sensor on at least one throw bar, wherein the throw bar connects free ends of at least two switch points and extends in a direction crossing the switch points;

placing at least two Hall-Effect switch components of the non-contact sensor an effective distance from the at least one magnet component;

moving the throw bar together with the switch points to a pre-determined position by a turnout machine, wherein the turnout machine is connected to a first end of the throw bar;

detecting an actual position of the throw bar and the switch points by the non-contact sensor; and generating a feedback signal reflecting the detected actual position of the throw bar and the switch points.

2. The method of claim 1 further comprising receiving or polling the feedback signal from the non-contact sensor and providing the feedback signal to a model railroad operator in a form of an illuminated display, and/or to a model railroad control system.

3. The method of claim 1 wherein the non-contact sensor detects the actual position of the throw bar and the switch points without mechanical or physical contact.

4. The method of claim 2 further comprising determining an action for the model railroad based on the feedback signal received from the non-contact sensor.

5. The method of claim 1 further comprising moving the at least one magnet component close to one of the at least two Hall-Effect switch components to turn on one of the at least two Hall-Effect switch components.

6. The method of claim 1 further comprising generating no feedback signal by the non-contact sensor if the throw bar and the switch points move partially toward, or drift away from the pre-determined position.

7. The method of claim 1 wherein, the at least one magnet is mounted on a second end of the throw bar and positioned external to a region between the at least two switch points.

8. The method of claim 1, wherein the at least one magnet is mounted in a center area of the throw bar.

9. The method of claim 1, wherein the at least one magnet and the at least two Hall-Effect switch components are vertically arranged, and the at least one magnet faces the at least two Hall-Effect switch components in a direction substantially perpendicular to a movement of the throw bar.

10. A model railroad turnout detecting apparatus comprising:

at least two switch points movable between at least two stock rails;

at least one throw bar connecting the switch points and extending in a direction crossing the switch points;

a non-contact sensor comprising:

at least one magnet component mounted on the throw bar; and at least two Hall-Effect switch components positioned at an effective distance from the magnet component; and a turnout machine connected to a first end of the throw bar;

wherein, the turnout machine is configured to move the throw bar together with the switch points to a pre-determined position, the non-contact sensor is configured to detect an actual position of the throw bar and the switch points responsive to a proximity of the at least one magnet component to at least one of the at least two Hall-Effect switch components, and the non-contact sensor is configured to generate a feedback signal reflecting the detected actual position of the throw bar and the switch points.

11. The model railroad turnout detecting apparatus of claim 10, wherein the magnet component is configured to turn on one of the at least two Hall-Effect switch components by moving close to the one of the at least two Hall-Effect switch components.

12. The model railroad turnout detecting apparatus of claim 10, wherein the at least one magnet component is mounted in a center area of the throw bar.

13. The model railroad turnout detecting apparatus of claim 10, wherein the at least one magnet component is mounted on a second end of the throw bar and positioned external to a region between the at least two switch points.

14. The model railroad turnout detecting apparatus of claim 10, wherein the at least one magnet component is external to a region between the at least two stock rails.

15. The model railroad turnout detecting apparatus of claim 10, wherein the at least one magnet and the at least two Hall-Effect switch components are vertically arranged.

16. The model railroad turnout detecting apparatus of claim 10, wherein the at least one magnet faces the at least two Hall-Effect switch components in a direction substantially perpendicular to a movement of the throw bar.

17. A method of detecting model railroad turnout points position comprising:

moving at least one throw bar together with at least two switch points to a pre-determined position by a turnout machine, wherein the throw bar connects free ends of the at least two switch points and extends in a direction crossing the switch points, and the turnout machine is connected to a first end of the throw bar;

detecting an actual position of the throw bar and the switch points by a non-contact sensor, wherein the non-contact sensor comprises at least one magnet component mounted on the throw bar and at least two Hall-Effect switch components positioned in an effective distance from the at least one magnet component; and generating a feedback signal reflecting the detected actual position of the throw bar and the switch points.

18. The method of claim 17 further comprising:

receiving or polling the feedback signal from the non-contact sensor and providing the feedback signal to a model railroad operator in a form of an illuminated display, and/or to a model railroad control system; and determining an action for the model railroad based on the feedback signal received from the non-contact sensor.

19. The method of claim 17 wherein the at least one magnet is mounted in a center area of the throw bar.

20. The method of claim 17 further comprising generating no feedback signal by the non-contact sensor if the throw bar and the switch points move partially toward, or drift away from the pre-determined position.

* * * * *